United States Patent [19]

Doi

[11] Patent Number: 4,907,902

[45] Date of Patent: Mar. 13, 1990

[54] MULTIPRINTING THERMAL TRANSFER INK RIBBON CASSETTE

[75] Inventor: Masahiro Doi, Shizuoka, Japan

[73] Assignee: Tokyo Electric Co., Ltd., Tokyo, Japan

[21] Appl. No.: 256,720

[22] Filed: Oct. 11, 1988

[30] Foreign Application Priority Data

Oct. 14, 1987 [JP] Japan ..... 62-157312[U]

[51] Int. Cl.[4] ..... B41J 35/36

[52] U.S. Cl. ..... 400/249; 400/703; 116/309

[58] Field of Search ..... 400/249, 703, 707.3, 400/234, 705.2; 116/309, 312, 311; 235/103; 360/132, 137; 242/197, 199, 200

[56] References Cited

U.S. PATENT DOCUMENTS

| | | | |
|---|---|---|---|
| 2,829,755 | 4/1958 | Tibbling | 400/707.3 |
| 2,944,750 | 7/1960 | Hall, Jr. | 235/103 |
| 3,618,563 | 11/1971 | Singer | 116/311 |
| 3,995,319 | 11/1976 | Harris | 360/137 |
| 4,001,891 | 1/1977 | Held | 116/309 |
| 4,530,612 | 7/1985 | Butera et al. | 400/249 |
| 4,544,291 | 10/1985 | Nagata et al. | 400/234 |
| 4,575,778 | 3/1986 | Vogelgesang | 235/103 |
| 4,633,356 | 12/1986 | Takahashi | 116/309 |
| 4,636,097 | 1/1987 | Goubeaux | 400/249 |
| 4,797,018 | 1/1989 | Hofmann et al. | 400/249 |

FOREIGN PATENT DOCUMENTS

| | | | |
|---|---|---|---|
| 57-103880 | 6/1982 | Japan | 400/249 |
| 58-151273 | 9/1983 | Japan | 400/249 |
| 58-163268 | 10/1983 | Japan | 400/249 |
| 219081 | 11/1985 | Japan | 400/249 |
| 61-125874 | 6/1986 | Japan | 400/208 |
| 62-75955 | 5/1987 | Japan | 400/211 |
| 184856 | 8/1987 | Japan | 400/225 |
| 244680 | 10/1987 | Japan | 400/703 |
| 2111913 | 7/1983 | United Kingdom | 400/249 |
| 2121002 | 12/1983 | United Kingdom | 235/103 |
| 02105 | 6/1983 | World Int. Prop. O. | 235/103 |
| 06536 | 11/1986 | World Int. Prop. O. | 235/103 |

*Primary Examiner*—William Pieprz

*Attorney, Agent, or Firm*—Frishauf, Holtz, Goodman & Woodward

[57] ABSTRACT

An ink ribbon cassette has a cassette case in which a thermal transfer ink ribbon subjected to a plurality of printing operations on the same surface at the same position. The case is alternately loaded in a thermal printer in a first loading posture and in a second loading posture which is a reversed posture to the first one to change a feed direction of the ribbon in the printer. A count display unit is provided on the case to record the number of times of use of the ribbon and display the number.

8 Claims, 4 Drawing Sheets

MULTIPRINTING THERMAL TRANSFER INK RIBBON CASSETTE

BACKGROUND OF THE INVENTION

1. Field of the Invention

The present invention relates to a thermal transfer ink ribbon cassette used in a printing apparatus having a thermal head, the ink ribbon cassette being provided with a cassette case for storing a thermal transfer ink ribbon and, more particularly, to a multiprinting thermal transfer ink ribbon cassette wherein an ink attached surface of the thermal transfer ink ribbon at the same position can be used for printing a plurality of times, and the ribbon cassette can be alternately mounted in the printing apparatus having the thermal head in the first loading posture and the second loading posture which is a turned over posture with respect to the first loading posture so that a feed direction of the thermal transfer ink ribbon in the printing apparatus can be changed.

2. Description of the Related Art

A conventional thermal transfer ink ribbon cassette used in a printing apparatus having a thermal head generally has two reel hubs. One end of the thermal transfer ink ribbon is fixed on one reel hub and is wound around this reel hub, and the other end of which is exposed outside the ribbon cassette between the two reel hubs and is then guided inside the ribbon cassette. The guided end is then fixed on the other reel hub. When printed matters printed by the printing apparatus described above are used for the business purpose, portion of a thermal ink ribbon used once is not reused, because many spots are formed in the once used portion of the ink ribbon, the spots being corresponding to the shapes of printed symbols such as characters, numerals, or lines, etc. on which no ink is attached or a little amount of ink is attached due to the transformation of most of ink to the printed symbols on the printed matter. When the thermal transfer ink ribbon used once is reused, no ink or little ink spots are formed in the printed characters, numerals, or lines in correspondence with the no ink or little ink spots on the once used portion in the ink ribbon.

Therefor, the conventional printing apparatus having a thermal head does not have a count displaying means for counting the number of times of use of the thermal transfer ink ribbon and displaying a count.

In recent years, however, a multiprinting thermal transfer ink ribbon cassette is developed and commercially available wherein an ink attached surface of the thermal transfer ink ribbon can be reused a plurality of times, and the ribbon cassette can be alternately mounted in the printing apparatus having the thermal head in the first loading posture and the second loading posture which is a turned over posture with respect to the first loading posture so that a feed direction of the thermal transfer ink ribbon in the printing apparatus can be changed. This multiprinting thermal transfer ink ribbon cassette can be sufficiently used within a predetermined number of times of use, even when printed matters printed by the printing apparatus are used for the business purpose. In other words, when the ink ribbon is used within the predetermined number of times, no ink or little ink spots are not formed in the printed characters, numerals, or lines. The multiprinting thermal transfer ink ribbon cassette is more economical than a conventional thermal transfer ink ribbon cassette which cannot be reused when it is used for printing symbols on a matter to be used for business purpose. Therefor, demand has arisen for using a multiprinting thermal transfer ink ribbon cassette when a printing apparatus having a thermal head is used for business purposes.

The multiprinting thermal transfer ink ribbon cassette can be used in the conventional printing apparatus provided with the thermal head but not with the count displaying means. However, if the number of uses of the multiprinting transfer ink ribbon is not accurately known, printing quality of the printed matter to be used for business purpose becomes low.

Printing apparatuses having count displaying means for counting the number of times of use of the ink ribbon or the printing means and for displaying the count are disclosed in Japanese patent disclosure (Kokai) No. 57-103880, Japanese patent publication No. 58-151273, and Japanese utility model disclosure (Kokai) No. 58-163268.

If a printing apparatus having a thermal head with a count displaying means for counting the number of times of use of the thermal transfer ink ribbon and displaying a counting number is developed with reference to the above references, problems which tend to be produced by use of a multiprinting thermal transfer ink ribbon cassette can be surely solved. However, a large amount of money is required to be invested to entirely replace the conventional non-counting printing apparatuses, each having a thermal head and capable of using a multiprinting thermal transfer ink ribbon cassette, with new thermal printing apparatuses having the count display means. In addition, the conventional printing apparatuses are of no use.

SUMMARY OF THE INVENTION

The present invention has been made in consideration of the above situation, and has as its object to provide a multiprinting thermal transfer ink ribbon cassette wherein the number of times of use of the thermal transfer ink ribbon can always be counted and displayed accurately, so that the ink ribbon cassette can be replaced with a new multiprinting thermal transfer ink ribbon cassette at a proper timing not to degrade printing quality of printed matters to be used for business purpose even when the multiprinting thermal transfer ink ribbon cassette is used in the abovementioned conventional printing apparatus without the count displaying means.

In order to achieve the above object of the present invention, there is provided a multiprinting thermal transfer ink ribbon cassette, comprising a cassette case and a thermal transfer ink ribbon stored in the cassette case and subjected to a plurality of printing operations on the same surface at the same position, the multiprinting thermal transfer ink ribbon cassette being alternately loaded in a printing apparatus having a thermal head in a first loading posture and in a second loading posture which is a reversed posture with respect to the first loading posture o as to change a feed direction of the thermal transfer ink ribbon in the printing apparatus, and further comprising count displaying means for recording the number of times of use of the thermal transfer ink ribbon and displaying the counted number.

Such a count displaying means arranged in a cassette case of the conventional multiprinting thermal transfer ink ribbon cassette can be provided at low cost.

The count displaying means preferably comprises an operation member extending out from the outer surface of the cassette case so as to gradually increase the displayed count upon operation of the operation member. Such operation member improves operability of the count displaying means.

If the count displaying means displays the counted number of times of use of the thermal transfer ink ribbon on a circumferential surface of the cassette case and at least one side surface thereof, the multiprinting thermal transfer ink ribbon cassette having the count displaying means can be conveniently used.

The count displaying means preferably comprises a substantially prismatic or cylindrical rotary member rotatably supported about an longitudinal axis thereof in the cassette case, a plurality of consecutive numbers circumferentially marked on at least part of a circumferential surface and at least part of one end face of the rotary member, openings formed in a circumferential surface of the cassette case and at least one side surface thereof so as to correspond to at least the part of the circumferential surface of the rotary member and at least the part of one end face thereof, and intermittent stopping means for stopping rotation of the rotary member when one of the plurality of numbers is exposed to corresponding one of the openings. And, the operation member is preferably fixed coaxially with the rotary member so as to be rotated together with the rotary member, and is preferably exposed from the circumferential surface of the cassette case or at least one side surface thereof. Such construction makes a multiprinting thermal transfer ink ribbon cassette with the count displaying means more convenient and more inexpensive.

The same technical advantages can be obtained when the count displaying means in the multiprinting thermal transfer ink ribbon cassette comprises an electric displaying means for sequentially incrementing the displayed number upon operation of the operation member.

DESCRIPTION OF THE PREFERRED EMBODIMENT

An embodiment and various modifications according to the present invention will be described in detail with reference to the accompanying drawings.

Figure 1:
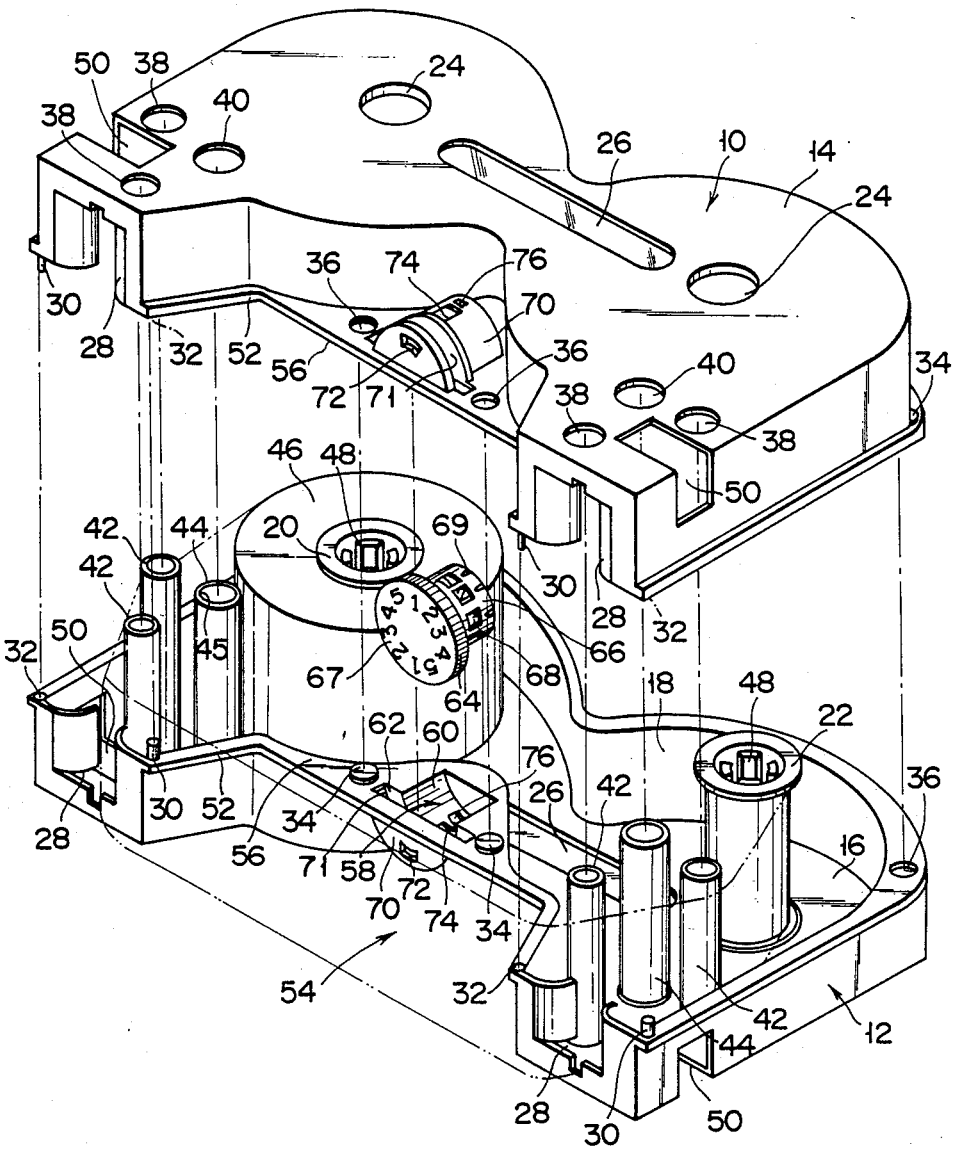
FIG. 1 is a schematic exploded perspective view of a multiprinting thermal ink ribbon cassette according to an embodiment of the present invention, wherein the multiprinting thermal transfer ink ribbon cassette is mounted in a printing apparatus such that rotational center axes of a pair of reel hubs horizontally extend and the pair of reel hubs are vertically spaced apart from each other.

FIG. 1 is a schematic exploded perspective view of a multiprinting thermal transfer ink ribbon cassette according to an embodiment of the present invention. A cassette case of the multiprinting thermal transfer ink ribbon cassette comprises a pair of symmetrical half cassette members 10 and 12 each having a substantially rectangular plane shape. The pair of half cassette members 10 and 12 constitute one side wall 14 and the other side wall 16 of the cassette case, respectively, and divide the circumferential surface of the cassette case into halves by a plane parallel to two side walls 14 and 16. The pair of half cassette members 10 and 12 have ribbon storage recesses 18 of a shape of a substantially pair of glasses on the opposite inner side surfaces. Cylindrical reel hubs 20 and 22 are arranged at centers of substantially circular portions of ribbon storage recesses 18, respectively. Reel hubs 20 and 22 extend to be parallel to each other between side walls 14 and 16 of the pair of half cassette members 10 and 12. Both ends of each of reel hubs 20 and 22 are rotatably supported in a corresponding pair of rotation support holes 24 formed in each of two side walls 14 and 16 of the pair of half cassette members 10 and 12. Internal observation windows 26 extending toward the pair of rotation support holes 24 are formed in side walls 14 and 16 of the pair of half cassette members 10 and 12 between the pair of rotation support holes 24, respectively.

Each of the pair of half cassette members 10 and 12 has a pair of ribbon insertion holes 28 formed at both ends of one of a pair of long sides of the circumferential wall. Each ribbon insertion hole 28 is formed in the inner side wall of half cassette member 10 or 12 and extends toward the outer surface thereof in a widthwise direction of the circumferential wall.

Positioning projections 30 and positioning recesses 32 are formed at a plurality of positions on peripheral portion located outside ribbon storage recess 18 in the inner side surface of each of the pair of half cassette members 10 and 12 so that projections 30 and recesses 32 of member 10 can be symmetrically engaged with associated recesses 32 and projections 30 of member 12 formed symmetrically with the projections and recesses of member 10. Therefore, the pair of half cassette members 10 and 12 are combined to constitute one cassette case.

A plurality of engaging projections 34 and a plurality engaging recesses 36 are formed on the peripheral portion of the inner side surfaces of the pair of half cassette members 12 and 10, respectively. Engaging recesses 36 of half cassette member 10 are frictionally engaged with engaging projections 34 of half cassette member 12 when the pair of half cassette members 10 and 12 are symmetrically engaged with each other, thereby firmly coupling the pair of half cassette members 10 and 12.

A pair of ribbon guide insertion holes 38 and one cassette guide insertion hole 40 are formed at each portion near the pair of ribbon insertion holes 28 on ribbon storage recesses 18 in the inner side surface of half cassette member 10. A pair of ribbon guides 42 and one cassette guide 44 are formed at each portion near the pair of ribbon insertion holes 28 on ribbon storage recesses 18 in the inner side surface of half cassette member 12 so as to be symmetrical with the pair of ribbon guide insertion holes 38 and one cassette guide insertion hole 40 of half cassette half 10. The pair of ribbon guides 42 and cassette guide 44 of half cassette member 12 are columnar members and extend toward the pair of ribbon guide insertion holes 38 and one cassette guide insertion hole 40 of half cassette member 10, respectively. When half cassette members 10 and 12 are combined to constitute one cassette case, as described above, the pair of ribbon guides 42 and one cassette guide 44 of half cassette member 12 are inserted into the pair of ribbon guide insertion holes 38 and one cassette guide insertion hole 40 of half cassette member 10, respectively. Each cassette guide 44 has cassette positioning hole 45 opened at an extended end thereof and coaxially extending therein.

Multiprinting thermal transfer ink ribbon 46, one end of which is fixed to one reel hub 20, is wound therearound. The other end of ink ribbon 46 is first inserted into one ribbon insertion hole 28 of the pair of half cassette members 10 and 12, which corresponds to reel hub 20, toward outside the tape cassette, and then inserted into another ribbon insertion hole 28 of the pair of half cassette members 10 and 12, which corresponds to reel hub 22, toward inside the tape cassette, and finally fixed on reel hub 22, as indicated by the two-dot chain line in FIG. 1. When reel hub 22 is rotated, multiprinting thermal transfer ink ribbon 46 on reel hub 20 is guided outside the tape cassette, as described above, and taken up by reel hub 22. Then, reel hub 20 is rotated, ink ribbon 46 wound around reel hub 22 can be drawn outside and wound on reel hub 20.

Multiprinting thermal transfer ink ribbon 46 is a thermal transfer ink ribbon which allows satisfactory thermal transfer by a plurality of times at a predetermined density. In this case, the predetermined density is defined as a printing density which does not degrade quality of printed matter for business purpose.

A plurality of engaging projections 48 radially extending inward are formed on the inner peripheral surface of each of the pair of reel hubs 20 and 22. When the pair of reel hubs 20 and 22 are mounted on a pair of reel shafts of a printing apparatus (not shown) having a thermal head, engaging projections 48 of reel hubs 20 and 22 are circumferentially engaged with a plurality of engaging projections radially extending on outer surfaces of the pair of reel shafts (not shown). Therefore, when one of the pair of reel shafts is rotated, the corresponding one of the pair of reel hubs 20 and 22 is rotated to take up multiprinting thermal transfer ink ribbon 46. The pair of reel shafts of the printing apparatus horizontally extend and are vertically spaced apart from each other. One of the pair of reel shafts is driven by a motor, but the other reel shaft will not be driven. However, the other reel shaft is rotated in a condition that it is subjected to a suitable rotational resistance by a brake mechanism to prevent the slack of ink ribbon 46 between the pair of reel hubs 20, 22.

A pair of ribbon sensor insertion openings 50 are formed on each of side walls 14 and 16 of half cassette members 10 and 12 near paired ribbon insertion holes 28 to extend into short sides of the circumferential wall of each of half cassette members 10 and 12.

In this embodiment, one of the long sides of the circumferential wall of the tape cassette at a position opposite to an outwardly exposed portion of multiprinting thermal transfer ink ribbon 46 is indented inwardly between the pair of ribbon insertion holes 28 formed at both ends of one long side described above to constitute thermal head insertion recess 52.

Cassette positioning guides (not shown) in the ribbon cassette loading portion of the printing apparatus are inserted into cassette positioning holes 45 of cassette guides 44, respectively, so that a tape cassette is loaded at a predetermined position in the ribbon cassette loading portion.

When the tape cassette is loaded at a predetermined position in the ribbon cassette loading portion of the printing apparatus, the pair of reel shafts of the printing apparatus are inserted into the pair of reel hubs 20 and 22 of the tape cassette. At the same time, a thermal head (not shown) of the printing apparatus is inserted into thermal head insertion recess 52 of the tape cassette. In this embodiment, the printing apparatus (not shown) is a line printer. The thermal head extends to be parallel to the rotational center axes of the pair of reel hubs 20 and 22. Therefore, in this embodiment, the width of multiprinting thermal transfer ink ribbon 46 is almost equal to the length of the thermal head and is relatively large.

In the multiprinting thermal transfer ink ribbon cassette of this embodiment, reel hub 20 on which multiprinting thermal transfer ink ribbon 46 is wound around is fitted on the lower reel shaft (not shown) of the printing apparatus, and reel hub 22 on which ink ribbon 46 is not wound around is fitted on the upper reel shaft (not shown) of the printing apparatus. In this state, the ribbon cassette is loaded at the predetermined position in the ribbon cassette loading portion of the printing apparatus. In the printing apparatus, when the upper reel shaft is driven to be rotated, multiprinting thermal transfer ink ribbon 46 is taken up from lower reel hub 20 to upper reel hub 22 in a condition that it is subjected to a suitable resistance at the lower reel shaft. Meanwhile, the thermal head of the printing apparatus is operated to print symbols, such as characters, numerals, or lines, etc. on recording paper (not shown) traveling on a platen located opposite to the thermal head with multiprinting thermal transfer ink ribbon 46 and the recording sheet being sandwiched therebetween. The posture of the ribbon cassette in the ribbon cassette loading portion in this state is defined as a first posture thereof.

When a completely taking up of multiprinting thermal transfer ink ribbon 46 from lower reel hub 20 to upper reel hub 22 is detected by the ribbon sensor (not shown) described above, the ribbon cassette is temporarily removed from the ribbon cassette loading portion and is reversed. Thereafter, the reversed ribbon cassette is loaded at the predetermined position in the ribbon cassette loading portion of the printing apparatus. In the ribbon cassette loaded in the ribbon cassette loading portion in a reversed state, reel hub 22 on which multiprinting thermal transfer ink ribbon 46 is wound around is fitted on the lower reel shaft of the printing apparatus, and reel hub 20 on which ink ribbon 46 is not wound around is fitted on the upper reel shaft of the printing apparatus. In this case, when the upper reel shaft of the printing apparatus is rotated, multiprinting thermal transfer ink ribbon 46 is taken up from lower reel hub 22 to upper reel hub 20 in a condition that it is subjected to a suitable resistance at the lower reel shaft. Meanwhile, the thermal head of the printing apparatus is operated to print symbols on recording paper (not shown). The posture of the ribbon cassette in the ribbon cassette loading portion in this state is defined as a second posture thereof.

The multiprinting thermal transfer ink ribbon cassette has count displaying means 54 for counting the number of changes in the mounting posture of the cassette case, i.e., the number of times of use of multiprinting thermal transfer ink ribbon 46, and displaying a counted number. Count displaying means 54 is mounted on substantially triangular areas 56 each of which is located along thermal head insertion recesses 52 on the peripheral portion of the inner side surface of each of the pair of half cassette members 10 and 12 between the pair of circular areas of associated ribbon storage recess 18. Count displaying means 54 includes symmetrical displaying means storage recesses 58 in areas 56 on the inner side surfaces of the pair of half cassette members 10 and 12. Each displaying means storage recess 58 comprises small-diameter half-columnar portion 60 and large-diameter half-disk-like portion 62 adjacent thereto and coaxial therewith. A longitudinal axis of displaying means storage recesses 58 extends in a direction substantially perpendicular to the long side of the circumferential wall of the tape cassette having thermal head insertion recesses 52. The length of large-diameter half-disk-like portion 62 in a direction parallel to the longitudinal axis is considerably smaller than the longitudinal length of small-diameter half-columnar portion 60.

Large-diameter disk-like operation member 64 is stored in the pair of large-diameter half-disk-like portions 62 of the pair of displaying means storage recesses 58 on the inner side surfaces of the pair of half cassette members 10 and 12. Small-diameter columnar rotary member 66 is stored in the pair of small-diameter half-columnar portions 60. Operation member 64 is coaxially with rotary member 66 and is formed integrally therewith.

Two numeric groups 67, each consisting of natural numbers "1" to "5", are marked on a free end face of operating member 64 to be located within the every range of about 180° in the circumferential direction with respect to the longitudinal axis, in which the numbers are arranged at equal angular intervals. Two numeric groups 68, each consisting of natural numbers "1" to "5", are marked on the circumferential surface of rotary member 66 to be located within the every range of about 180° in the circumferential direction, in which the numbers are arranged at equal angular intervals. A plurality of lock grooves 69 are formed at equal angular intervals on the circumferential surface of rotary member 66 in the circumferential direction so as to correspond to each number in the two numeric groups 68.

Outer side surfaces of the pair of half cassette members 10 and 12 at positions corresponding to areas 56 are expanded to be similar to the displaying means storage recesses 58. The areas on expanded portions 70 corresponding to the circumferential surface of operation member 64 are cut out to expose the circumferential surface, thereby forming operation member manipulation openings 71. An area on each expanded portion 70 corresponding to the free end face of operation member 64 has first number display opening 72 for displaying one number in each numeric group 67 on the free end face of the operation member 64. An area on each expanded portion 70 corresponding to the circumferential surface of rotary member 66 has second number display opening 74 for displaying one number in each numeric group 68 on the circumferential surface of the rotary member 66. A pair of identical numbers in the two numeric groups 67 marked on the free end face of operation member 64 are displayed in the paired first number display openings 72. A pair of identical numbers in the two numeric groups 68 marked on the circumferential surface of rotary member 66 are displayed in the paired second number display openings 74. The number displayed in each first number display opening 72 is the same as that in each second number display opening 74.

Elastic lock pawls 76 are respectively formed on the areas in expanded portions 70 corresponding to the circumferential surface of rotary member 66 to engage with corresponding ones of lock grooves 69 on the circumferential surface of rotary member 66.

Figure 2:
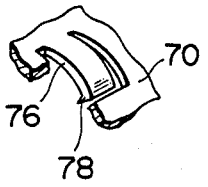
FIG. 2 is an enlarged perspective view only showing an elastic lock pawl of an intermittent stopping means included in the counter displaying means in the multiprinting thermal transfer ink ribbon cassette shown in FIG. 1.

Elastic lock pawls 76 are partially cut out to have tongue shapes from expanded portions 70 of the paired half cassette members 10 and 12 made of an elastic plastic material, as shown in FIG. 2, so that free ends of elastic lock pawls 76 can be elastically deformed in the radial direction of expanded portions 70. Engaging projections 78 are formed at the free ends of elastic lock pawls 76, respectively, to extend inwardly in the radial direction of expanded portion 70. Each engaging projection 78 engages with one of grooves 69 formed on the circumferential surface of rotary member 66 housed in the paired displaying means storage recesses 58 of the paired half cassette members 10 and 12.

When the circumferential surface of operation member 64 exposed outside is manipulated to rotate rotary member 66 within the paired displaying means storage recesses 58, rotation of rotary member 66 is temporarily stopped at every time in which engaging projections 78 of elastic lock pawls 76 engage with corresponding ones of lock grooves 69 on the circumferential surface of rotary member 66. That is, elastic lock pawls 76 and the plurality of lock grooves 69 on the circumferential surface of rotary member 66 constitute an intermittent stopping means for temporarily stopping a rotation of rotary member 66 at every predetermined angular interval. The predetermined angular interval is determined to change the numbers in numeric groups 67 and 68 on operating member 64 and rotary member 66, displayed in first and second number display openings 72 and 74 of the paired expanded portions 70 of the paired half cassette members 10 and 12, one by one.

In the multiprinting thermal transfer ink ribbon cassette having the above construction according to the embodiment of the present invention, whenever the loading posture of the ribbon cassette in the printing apparatus (i.e., whenever traveling of ink ribbon 46 in one direction is completed), the user manipulates operation member 64 of count displaying means 54 to change the number, displayed in each of the paired first number display openings 72 and, the paired second number display openings 74, by one. Therefore, the number of times of change in loading posture of the ribbon cassette in the printing apparatus (i.e., the number of times of use of multiprinting thermal transfer ink ribbon 46) can be counted, recorded, and displayed. Therefore, the ink ribbon cassette can be replaced with a new multiprinting thermal transfer ink ribbon cassette at a proper timing since the number of times of use of the ribbon cassette can be accurately counted, recorded, and displayed. Therefore, degradation of printed matter for business purpose can be surely prevented.

Figure 3:
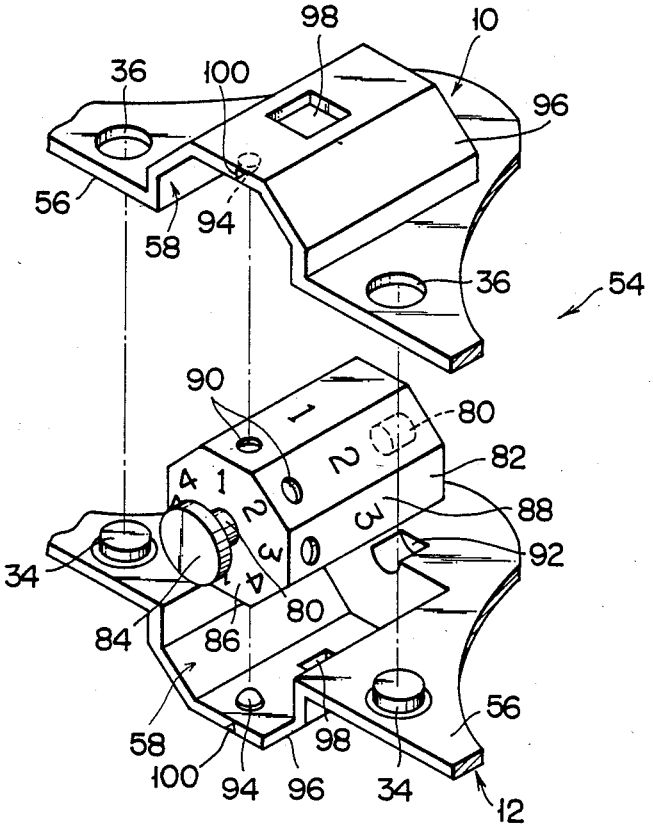
FIG. 3 is a schematic enlarged exploded perspective view of a first modification of the count displaying means.

FIG. 3 shows a first modification of count displaying means 54.

Count displaying means 54 of the first modification comprises octagonal rotary member 82 having rotating shafts 80 coaxially extending from both end faces thereof. An extended end of on rotating shaft 80 extending from one end face of rotary member 82 has coaxial disk-like operation member 84 having a diameter considerably smaller than that of rotary member 82. Two numeric groups 86, each consisting of natural numbers "1" to "5", are marked on one end face of rotary member 82 to be located within the every range of about 180°, in the circumferential direction, in which the numbers are arranged at equal angular intervals. Two numeric groups 88, each consisting of natural numbers "1" to "5", are marked on the circumferential surface of rotary member 82 to be located within the every range of about 180°, in the circumferential direction, in which the numbers are arranged at equal angular intervals. A plurality of lock holes 90 are formed at equal angular intervals on the circumferential surface of rotary member 82 in the circumferential direction so as to correspond to each number in the two numeric groups 80.

Each displaying means storage recess 58 formed on each area 56 in inner side surfaces of the paired half cassette members 10 and 12 has a half polygonal shape having a radius larger than the radius of rotary member 82. Rotation support grooves 92 for rotatably supporting another rotating shaft 80, to which operation member 84 of rotary member 82 is not connected, are formed on areas 56 in inner side surfaces so as to be coaxial and continuous with displaying means storage recesses 58. Each displaying means storage recesses 58 is open to the each one long side of the paired half cassette members 10 and 12 providing thermal head insertion recess 52. Rotary member 82, which is housed in the paired displaying means storage recesses 58 of the paired half cassette members 10 and 12 and another rotating shaft 80 of which is supported by the paired rotation support grooves 92 of the paired half cassette members 10 and 12, is exposed at its one end face from the openings of displaying means storage recesses 58 so that operation member 84 protrudes towards the outside through the above described openings.

Lock projections 94 are formed on symmetrical positions on the inner circumferential surfaces of displaying means storage recesses 58 to engage with corresponding ones of lock holes 90. Rotary member 82 is supported in the paired displaying means storage recesses 58 of the paired half cassette members 10 and 12 by paired lock projections 94 and paired rotation support grooves 92 so as to be rotatable about another shaft 80.

Areas on the outer side surface of the paired half cassette members 10 and 12 corresponding to displaying means storage recesses 58 on count displaying means loading areas 56 in the inner side surfaces of the half cassette members 10 and 12 are expanded similar to displaying means storage recesses 58. Number display opening 98 for displaying each identical number in two numerical groups 88 marked on the circumferential surface of rotary member 82 is formed in an area on the outer surface of expanded portions 96 corresponding to the circumferential surface of rotary member 82. A pair of identical numbers in two numerical groups 88 on the circumferential surface of rotary member 82 are displayed in the paired number display openings 98 of the paired expanded portions 96 of the paired half cassette members 10 and 12.

In the first modification described above, when operation member 84 protruded outside from the paired displaying means storage recesses 58 is manipulated to rotate rotary member 82 in displaying means storage recesses 58, rotation of rotary member 82 is stopped whenever lock projections 94 engage with corresponding ones of lock holes 90 on the circumferential surface of rotary member 82. That is, lock projections 94 and lock holes 90 on the circumferential surface of rotary member 82 constitute an intermittent stopping means for stopping rotary member 82 every predetermined angular interval. The predetermined angular interval is determined to change the numbers in numeric groups 88 on rotary member 82, displayed in number display openings 98 of the paired expanded portions 96 of the paired half cassette members 10 and 12, one by one.

Number designating marks 100 which designate identical numbers in two numerical groups 86 on the end face of rotary member 82 are formed at opening ends of the paired displaying means storage recesses 58 of the paired half cassette members 10 and 12, respectively. Each identical number designated by the each number designating mark 100 is the same as that displayed in each number display opening 98.

Figure 4:
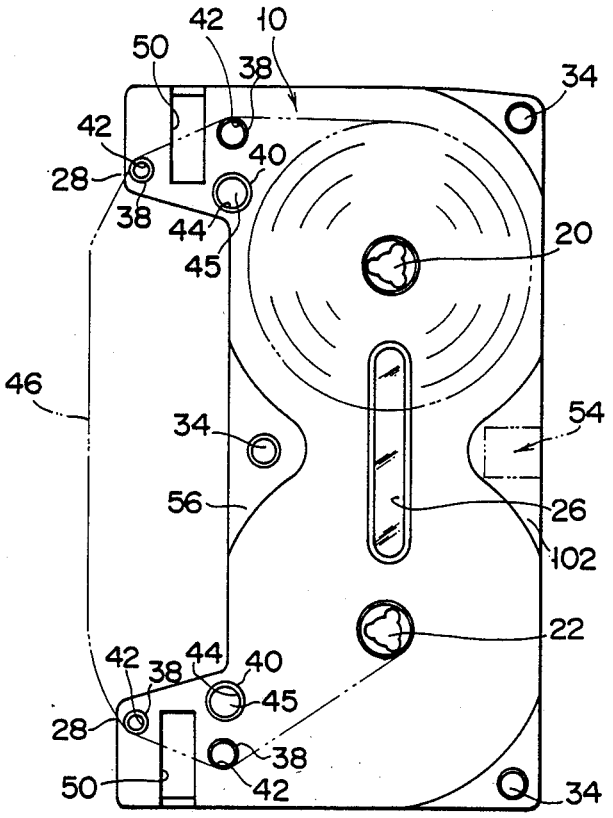
FIG. 4 is a schematic side view showing another layout of the count displaying means with respect to the multiprinting thermal transfer ink ribbon cassette shown in FIG. 1.

FIG. 4 shows another mounting position of count displaying means 54 in the multiprinting thermal transfer ink ribbon cassette according to the first embodiment of the present invention. Count displaying means 54 in the ribbon cassette in FIG. 4 is arranged in substantially triangular areas 102 each of which is located at a position on the peripheral portion of the inner side surface of each of the paired half cassette members 10 and 12, the position being opposing to thermal head insertion recess 52 and surrounded at its both sides by a paired circular areas of ribbon storage recesses 18. Count displaying means 54 arranged in areas 102 may have the same arrangement as in the first embodiment of FIG. 1, in the first modification of FIG. 3, or in a second modification (to be described later) as an electric displaying means.

Figure 5:
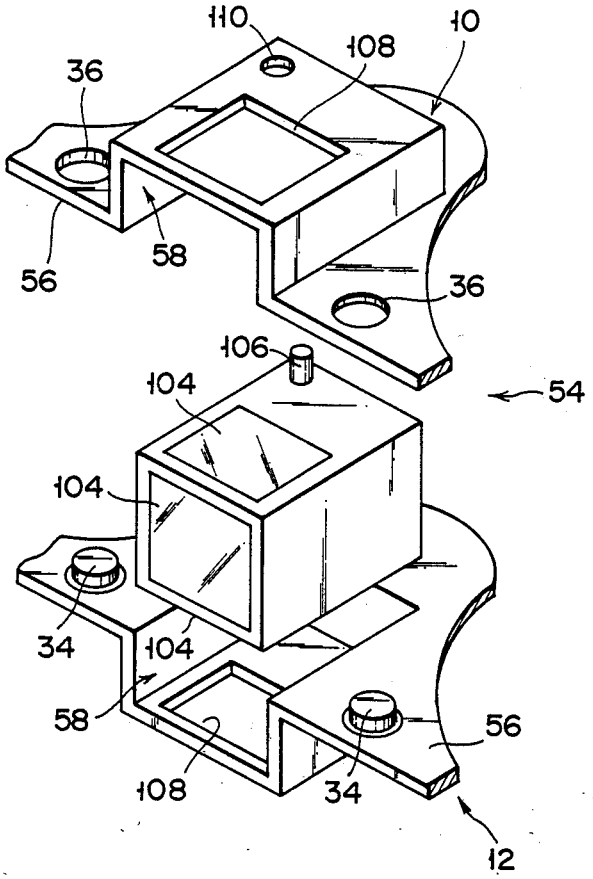
FIG. 5 is a schematic enlarged exploded perspective view showing a second modification of the count displaying means.

Count displaying means 54 of the second modification is schematically shown in FIG. 5.

Count displaying means 54 of the second modification comprises a rectangular unit having electric display means 104 such as liquid display elements on its three surfaces. Operation member 106 extends from one surface of the unit. The unit includes a battery. Upon operation of operation member 106, natural numbers starting from "1" can be displayed on three electric display means 104.

Displaying means storage recesses 58 formed on areas 56 in the inner side surfaces of the paired half cassette members 10 and 12 have a shape corresponding to the outer surface of count displaying means 54 as a unit as described above and are open to the one long sides of the circumferential walls of the paired half cassette members 10 and 12 providing thermal head insertion recess 52. Count displaying means 54 housed in the paired displaying means storage recesses 58 of the paired half cassette members 10 and 12 exposes central electric display means 104 through the openings of the displaying means storage recesses 58. Remaining two electric displaying means 104 of count displaying means 54 oppose the bottoms of the inner circumferential surfaces of the paired displaying means storage recesses 58 and are exposed outside through openings 108 formed in the bottoms. Operation member insertion hole 110 for receiving operation member 106 of count displaying means 54 is formed in one bottom. Operation member 106 inserted through operation member insertion hole 110 is exposed to the outer space, so that a user can externally manipulate operation member 106.

What is claimed is:

1. A multiprinting thermal transfer ink ribbon cassette, comprising:

a cassette case having a circumferential surface and at least one side surface;

a thermal transfer ink ribbon stored in said cassette case and subjected to a plurality of printing operations on the same surface at the same position thereof;

said multiprinting thermal transfer ink ribbon cassette being alternately loadable in a printing apparatus having a thermal head in a first loading posture and in a second loading posture which is a reversed posture with respect to the first loading posture so as to change a feed direction of said thermal transfer ink ribbon in said printing apparatus; and count displaying means for recording a counted number of times of use of said thermal transfer ink ribbon and for displaying the counted number;

said count displaying means comprising an operation member extending out from an outer surface of said cassette case, said operation member being manipulable to increase the displayed count; and said count displaying means further comprising a rotary member rotatably supported about a longitudinal axis thereof in said cassette case, said operation member being fixed coaxially with said rotary member so as to be rotated together with said rotary member; said operation member being exposed from at least one of said circumferential surface of said cassette case and said at least one side surface thereof; a plurality of consecutive numbers circumferentially marked on at least part of a circumferential surface and at at least part of one end face of said rotary member; openings formed in said circumferential surface of said cassette case in said at least one side surface thereof so as to correspond to at least the part of said circumferential surface of said rotary member and at least the part of said one end face thereof; and intermittent stopping means for stopping rotation of said rotary member when one of said plurality of numbers is exposed to a corresponding one of said openings.

2. A cassette according to claim 1, wherein said count displaying means includes means for displaying said counted number of times of use of said thermal transfer ink ribbon on a circumferential surface of said cassette case and at at least one side surface thereof.

3. A cassette according to claim 1, wherein said operation member is manipulable to gradually increase the displayed count.

4. A cassette according to claim 1, wherein said rotary member comprises a substantially prismatic member.

5. A cassette according to claim 1, wherein said rotary member comprises a substantially cylindrical member.

6. A cassette according to claim 1, further comprising two reel hubs on which both ends of said thermal transfer ink ribbon are fixed, the ribbon being moved between reel hubs to be wound around the reel hub located on a forward end side of the moved ribbon; and wherein said count displaying means is located at a position on said cassette case which is located outside of a tape storage space in said cassette case.

7. A cassette according to claim 6, wherein the rotational center line of said rotary member of said count displaying means crosses a center connecting line which crosses the rotational center lines of said two reel hubs at right angles.

8. A cassette according to claim 1, wherein said operation member is manually manipulable by a user at a time of changing the loading posture of the cassette.

* * * * *